US011085107B2

(12) United States Patent
Kizu et al.

(10) Patent No.: US 11,085,107 B2
(45) Date of Patent: Aug. 10, 2021

(54) HIGH-STRENGTH STEEL SHEET AND METHOD OF MANUFACTURING THE SAME

(71) Applicant: JFE Steel Corporation, Tokyo (JP)

(72) Inventors: Taro Kizu, Tokyo (JP); Akimasa Kido, Tokyo (JP); Tetsushi Tadani, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 425 days.

(21) Appl. No.: 16/063,728

(22) PCT Filed: Dec. 13, 2016

(86) PCT No.: PCT/JP2016/087023
§ 371 (c)(1),
(2) Date: Jun. 19, 2018

(87) PCT Pub. No.: WO2017/110579
PCT Pub. Date: Jun. 29, 2017

(65) Prior Publication Data

US 2019/0309396 A1 Oct. 10, 2019

(30) Foreign Application Priority Data

Dec. 22, 2015 (JP) ..... JP2015-250262

(51) Int. Cl.
*C22C 38/00* (2006.01)
*C21D 8/02* (2006.01)
(Continued)

(52) U.S. Cl.
CPC ..... *C22C 38/001* (2013.01); *B21B 45/08* (2013.01); *C21D 8/0226* (2013.01);
(Continued)

(58) Field of Classification Search
CPC ..... C22C 38/001; C22C 38/60; C22C 38/12; C22C 38/00; C22C 38/002; C22C 38/02;
(Continued)

(56) References Cited

U.S. PATENT DOCUMENTS 7,485,194 B2 * 2/2009 Mega ..... C21D 8/0226 148/320
7,828,912 B2 11/2010 Okamoto et al.
(Continued)

FOREIGN PATENT DOCUMENTS

CN 1450191 A 10/2003
CN 1759198 A 4/2006
(Continued)

OTHER PUBLICATIONS

Office Action dated Jun. 12, 2019, of counterpart Korean Application No. 2018-7017178, along with a Concise Statement of Relevance of Office Action in English.
(Continued)

*Primary Examiner* — John A Hevey
(74) *Attorney, Agent, or Firm* — DLA Piper LLP (US)

(57) ABSTRACT

A steel sheet has a composition containing, by mass %, C: 0.04% to 0.20%, Si: 0.6% to 1.5%, Mn: 1.0% to 3.0%, P: 0.10% or less, S: 0.030% or less, Al: 0.10% or less, N: 0.010% or less, one, two, or all of Ti, Nb, and V in an amount of 0.01% to 1.0% each, and the balance being Fe and inevitable impurities, a microstructure including, in terms of area ratio, 50% or more of ferrite, in which an average grain diameter at a position located 50 μm from a surface of the steel sheet in a thickness direction is 3000×(tensile strength TS (MPa))$^{-0.85}$ μm or less, C precipitates having a grain diameter of less than 20 nm formed in steel is 0.010 mass % or more, and a amount of precipitated Fe is 0.03 mass % to 1.0 mass %, and a roughness Ra of 3.0 μm or less.

16 Claims, 3 Drawing Sheets

(51) Int. Cl.

| | |
|---|---|
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C23C 2/02*** | (2006.01) |
| ***C25D 5/48*** | (2006.01) |
| ***C22C 38/60*** | (2006.01) |
| ***C23C 2/28*** | (2006.01) |
| ***C23C 2/06*** | (2006.01) |
| ***C23C 2/40*** | (2006.01) |
| ***B21B 45/08*** | (2006.01) |
| ***C21D 9/68*** | (2006.01) |

(52) U.S. Cl.
CPC ..... *C21D 8/0263* (2013.01); *C21D 9/46* (2013.01); *C21D 9/68* (2013.01); *C22C 38/00* (2013.01); *C22C 38/002* (2013.01); *C22C 38/02* (2013.01); *C22C 38/04* (2013.01); *C22C 38/06* (2013.01); *C22C 38/14* (2013.01); *C22C 38/60* (2013.01); *C23C 2/02* (2013.01); *C23C 2/06* (2013.01); *C23C 2/28* (2013.01); *C23C 2/40* (2013.01); *C25D 5/48* (2013.01); *C21D 2211/003* (2013.01); *C21D 2211/004* (2013.01); *C21D 2211/005* (2013.01)

(58) Field of Classification Search
CPC ..... C22C 38/04; C22C 38/06; C22C 38/14; C22C 2/28; C25D 5/48; C21D 2211/003; C21D 2211/004; C21D 2211/005; C21D 8/0263; C21D 8/0226; C21D 9/46; C21D 9/68; C23C 2/04; C23C 2/28; C23C 2/06; C23C 2/40; C23C 2/02; C23G 1/08; B21B 45/08
See application file for complete search history.

(56) References Cited

U.S. PATENT DOCUMENTS

2009/0004040 A1* 1/2009 Kato ..... C22C 38/004 420/38
2009/0277544 A1* 11/2009 Toyoda ..... C22C 38/02 148/593
2012/0107633 A1* 5/2012 Nakagawa ..... C21D 8/0273 428/577
2014/0332123 A1* 11/2014 Nakagawa ..... C22C 38/06 148/645

FOREIGN PATENT DOCUMENTS

| | | | |
|---|---|---|---|
| CN | 102471844 | A | 5/2012 |
| CN | 102906295 | A | 1/2013 |
| CN | 103003460 | A | 3/2013 |
| CN | 103917680 | A | 7/2014 |
| CN | 105143485 | A | 12/2015 |
| EP | 1 350 859 | A1 | 8/2003 |
| EP | 1 607 489 | A1 | 12/2003 |
| EP | 2 453 032 | A1 | 5/2012 |
| EP | 2 554 705 | A1 | 2/2013 |
| EP | 2 594 656 | A1 | 5/2013 |
| EP | 2 759 613 | A1 | 7/2014 |
| EP | 2 987 883 | A1 | 2/2016 |
| JP | 2001-234280 | A | 8/2001 |
| JP | 3537039 | B2 | 6/2004 |
| JP | 2006-161111 | A | 6/2006 |
| JP | 4424185 | B2 | 3/2010 |
| JP | 2014-208876 | A | 6/2014 |
| JP | 5574070 | B1 | 7/2014 |
| JP | 2015-098629 | A | 5/2015 |
| JP | 2015-190015 | | 11/2015 |
| WO | 2013/069251 | A1 | 5/2013 |
| WO | 2017/006563 | A1 | 1/2017 |

OTHER PUBLICATIONS

Office Action dated Jul. 10, 2019, of counterpart Chinese Application No. 201680074385.3, along with a Concise Statement of Relevance of Office Action in Enalish.
Extended European Search Report dated Aug. 23, 2018, of counterpart European Application No. 16878470.0.
Office Action dated Aug. 7, 2019 of counterpart European Application No. 16878470.0.

* cited by examiner

HIGH-STRENGTH STEEL SHEET AND METHOD OF MANUFACTURING THE SAME

TECHNICAL FIELD

This disclosure relates to a high-strength steel sheet having excellent bendability that can most suitably be used as a material for suspension and chassis members such as lower arms and frames, structural members such as pillars and members, their stiffening members, door impact beams, and seat members of automobiles and for structural members used for vending machines, desks, home electrical appliances, OA equipment, building materials and so forth, and a method of manufacturing the steel sheet.

BACKGROUND

Nowadays, in response to growing concerns about global environmental problems, there is an increasing demand to decrease the amount of $CO_2$ emissions. Moreover, for example, there is an ever-increasing need to improve fuel efficiency and decrease exhaust gas emissions by decreasing the weight of automobiles in the automobile industry. In addition, there is a large need for collision safety. Decreasing the thickness of parts used for automobiles is the most effective way to decrease the weight of the automobiles. That is, to decrease the weight of automobiles while maintaining the strength of automobiles, decreasing the thickness of steel sheets, which are materials for parts of automobiles, by improving the strength of the steel sheet is effective.

Generally, since press formability deteriorates with an improvement in the strength of steel sheets, there is a growing trend toward preferably using a forming method involving mainly easy bend forming as strength improves. When a blank material that has been cut by performing punching is subjected to bend forming, since there is an increasingly significant trend for a crack to occur in a punched end portion with an improvement in the strength of steel sheets, it is difficult to improve the strength of steel sheets even in steel sheets for materials subjected mainly to bending work.

As an example of a conventional high-strength steel sheet having excellent bendability, Japanese Unexamined Patent Application Publication No. 2006-161111 discloses a technique to manufacture a hot-rolled steel sheet having a chemical composition containing, by mass %, C: more than 0.055% and less than 0.15%, Si: less than 1.2%, Mn: more than 0.5% and less than 2.5%, Al: less than 0.5%, P: less than 0.1%, S: less than 0.01%, N: less than 0.008%, and one, two, or more selected from V: more than 0.03% and less than 0.5%, Ti: more than 0.003% and less than 0.2%, Nb: more than 0.003% and less than 0.1%, and Mo: more than 0.03% and less than 0.2%, in which the relationship $-0.04<C-(Ti-3.43N)\times0.25-Nb\times0.129-V\times0.235-Mo\times0.125<0.05$ is satisfied, and a microstructure including 70 vol. % or more of isometric ferrite, 5 vol. % or less of martensite, and the balance including one, two, or more of ferrite other than isometric ferrite, bainite, cementite, and pearlite, in which the isometric ferrite has a Vickers hardness Hv that satisfies $Hv\geq0.3\times TS\ (MPa)+10$.

In addition, as an example of a high-strength steel sheet having excellent bendability and shearing workability, Japanese Unexamined Patent Application Publication No. 2015-98629 discloses a technique of manufacturing a hot-rolled steel sheet having a chemical composition containing, by mass %, C: 0.01% to 0.2%, Si: 0.01% to 2.5%, Mn: 0.5% to 3.0%, P: 0.02% or less, S: 0.005% or less, Sol. Al: 0.02% to 0.5%, Ti: 0.02% to 0.25%, N: 0.010% or less, Nb: 0% to 0.1%, V: 0% to 0.4%, Mo: 0% to 0.4%, W: 0% to 0.4%, Cr: 0% to 0.4%, and Ca, Mg, and REM in a total amount of 0% to 0.01% and a microstructure including, in terms of area ratio, ferrite and bainite in a total amount of 89% or more, pearlite in an amount of 5% or less, martensite in an amount of 3% or less, and retained austenite in an amount of 3% or less, in which the Vickers hardness HvC of the central portion in the thickness direction and the Vickers hardness HvS at a position located 100 μm from the surface layer satisfy $HvS/HvC\leq0.80$.

Moreover, as an example of a high-strength steel sheet having excellent bendability and fatigue resistance in a punched portion, Japanese Patent No. 5574070 discloses a technique of manufacturing a hot-rolled steel sheet having a chemical composition containing, by mass %, C: 0.05% to 0.15%, Si: 0% to 0.2%, Al: 0.5% to 3.0%, Mn: 1.2% to 2.5%, P: 0.1% or less, S: 0.01% or less, N: 0.007% or less, Ti: 0.03% to 0.10%, Nb: 0.008% to 0.06%, V: 0% to 0.12%, $Si+Al: 0.8\times(Mn-1)\%$ or more, and Ti+Nb: 0.04% to 0.14% and a microstructure including, in terms of area ratio, martensite and retained austenite in a total amount of 3% to 20%, ferrite in an amount of 50% to 95%, and pearlite in an amount of 3% or less, in which the thickness in the sheet thickness direction of a region in which network oxides exist is less than 0.5 μm in a surface layer.

However, in the technique according to JP '111, there is a problem in that bendability of the punched material is low. In addition, in the technique according to JP '629, although there is an improvement in shearing workability, there is a problem in that there is no significant effect regarding bending work after shearing has been performed. In the technique according to JP '070, although there is an improvement in fatigue resistance in a punched portion, there is a problem in that there is no improvement in the bending workability of the punched material because the stress load level in bending work after punching has been performed differs significantly.

It could therefore be helpful, in view of the situation described above, to provide a high-strength steel sheet having excellent bendability and a method of manufacturing the steel sheet.

SUMMARY

We found that a microstructure including ferrite that is excellent in terms of ductility and bendability as a main phase is formed. In addition, by forming Fe precipitates in the form of cementite so that the precipitates function as starting points at which cracks occur when punching is performed, a smooth punched end surface is obtained. In addition, by decreasing the surface roughness of a steel sheet, generation of cracks when bending deformation is performed is inhibited in the vicinity of the end surface. Moreover, by forming a microstructure having a small grain diameter in the surface layer of a steel sheet so that fine precipitates having a grain diameter of less than 20 nm are formed, crack propagation is inhibited. We found that, with this, it is possible to significantly improve bendability.

By controlling the ferrite fraction, fine precipitates having a grain diameter of less than 20 nm, the amount of Fe precipitates, grain diameter in the vicinity of the surface layer of a steel sheet, and the surface roughness of a steel sheet through control of descaling pressure, rolling temperature, and the accumulated rolling reduction ratio when hot rolling is performed on a steel slab in which the contents of C, Si, Mn, P, S, Al, N, Ti, Nb, and V are controlled and through control of impingement pressure, cooling rate, the temperature and time of slow cooling, and coiling temperature when cooling is performed after hot rolling is performed. By controlling the ferrite fraction, fine precipitates having a grain diameter of less than 20 nm, the amount of precipitated Fe, grain diameter in the vicinity of the surface layer of a steel sheet, and the surface roughness of a steel sheet, it is possible to significantly improve the bendability of a high-strength steel sheet.

We thus provide

[1] A high-strength steel sheet having a chemical composition containing, by mass %, C: 0.04% to 0.20%, Si: 0.6% to 1.5%, Mn: 1.0% to 3.0%, P: 0.10% or less, S: 0.030% or less, Al: 0.10% or less, N: 0.010% or less, one, two, or all of Ti, Nb, and V in an amount of 0.01% to 1.0% each, and the balance being Fe and inevitable impurities, a microstructure including, in terms of area ratio, 50% or more of ferrite, in which an average grain diameter at a position located 50 μm from a surface of the steel sheet in a thickness direction is 3000×[tensile strength TS (MPa)]$^{-0.85}$ μm or less, a C content in precipitates having a grain diameter of less than 20 nm formed in steel is 0.010 mass % or more, and an amount of precipitated Fe is 0.03 mass % to 1.0 mass %, and an arithmetic average roughness Ra of 3.0 μm or less.

The amount of precipitated Fe is an amount of Fe precipitated in a form of cementite.

[2] The high-strength steel sheet according to item [1] above, in which the chemical composition further contains, by mass %, one, two, or all of Mo, Ta, and W in an amount of 0.005% to 0.50% each.

[3] The high-strength steel sheet according to item [1] or [2] above, in which the chemical composition further contains, by mass %, one, two, or all of Cr, Ni, and Cu in an amount of 0.01% to 1.0% each.

[4] The high-strength steel sheet according to any one of items [1] to [3] above, in which the chemical composition further contains, by mass %, one or both of Ca and REM in an amount of 0.0005% to 0.01% each.

[5] The high-strength steel sheet according to any one of items [1] to [4] above, in which the chemical composition further contains, by mass %, Sb: 0.005% to 0.050%.

[6] The high-strength steel sheet according to any one of items [1] to [5] above, in which the chemical composition further contains, by mass %, B: 0.0005% to 0.0030%.

[7] The high-strength steel sheet according to any one of items [1] to [6] above, the steel sheet further having a coating layer on the surface thereof.

[8] A method of manufacturing a high-strength steel sheet, the method including casting a steel slab having the chemical composition according to any one of items [1] to [6] above, reheating the steel slab to a temperature of 1200° C. or higher, optionally without reheating, performing hot rolling on the steel slab in which descaling is performed with an impingement pressure of 3 MPa or more after rough rolling has been performed and before finish rolling is performed with an accumulated rolling reduction ratio of 0.7 or more in a temperature range of 950° C. or lower and a finishing delivery temperature of 800° C. or higher, performing rapid water cooling with a maximum impingement pressure of 5 kPa or more at an average cooling rate of 30° C./s or more after finish rolling has been performed and before slow cooling is started, performing slow cooling from a slow-cooling start temperature of 550° C. to 750° C. at an average cooling rate of less than 10° C./s for a slow-cooling time of 1 second to 10 seconds, further performing cooling to a coiling temperature of 350° C. or higher and lower than 530° C. at an average cooling rate of 10° C./s or more, and performing coiling at a coiling temperature of 350° C. or higher and lower than 530° C.

[9] The method of manufacturing a high-strength steel sheet according to item [8] above, the method further including performing pickling after the coiling has been performed.

[10] The method of manufacturing a high-strength steel sheet according to item [9] above, the method further including performing a hot-dip coating treatment following annealing at a soaking temperature of 750° C. or lower after the pickling has been performed.

[11] The method of manufacturing a high-strength steel sheet according to item [10] above, the method further including performing an alloying treatment at an alloying treatment temperature of 460° C. to 600° C. for a holding time of 1 second or more after the hot-dip coating treatment has been performed.

[12] The method of manufacturing a high-strength steel sheet according to item [9] above, the method further including performing an electroplating treatment after the pickling has been performed.

[13] The method of manufacturing a high-strength steel sheet according to any one of items [8] to [12] above, the method further including processing with a thickness-decreasing ratio of 0.1% to 3.0% after the coiling, the pickling, the hot-dip coating treatment, the alloying treatment, or the electroplating treatment has been performed.

[14] A method of manufacturing a high-strength steel sheet, the method including performing a coating treatment on the high-strength steel sheet according to any one of items [1] to [6] above.

The term "a high-strength steel sheet" denotes a steel sheet having a tensile strength (TS) of 780 MPa or more, and the meaning of the term "a high-strength steel sheet" includes a hot-rolled steel sheet and a steel sheet manufactured by performing a surface treatment such as a galvanizing treatment, a galvannealing treatment, or an electrogalvanizing treatment on a hot-rolled steel sheet. Moreover, the meaning includes a steel sheet manufactured by further forming a film through the use of, for example, a chemical conversion treatment on the surface of the hot-rolled steel sheet or on the surface of the steel sheet which has been subjected to a surface treatment. In addition, the term "excellent in terms of bendability" denotes excellent bending workability when punching and forming are performed.

It is thus possible to obtain a high-strength steel sheet having excellent bendability. Since the high-strength steel sheet has a tensile strength of 780 MPa or more and excellent bendability, which is required for a punched material, the steel sheet can preferably be used for, for example, the structural members of automobiles and thereby an advantageous effect on the industry.

DETAILED DESCRIPTION

Figure 1:
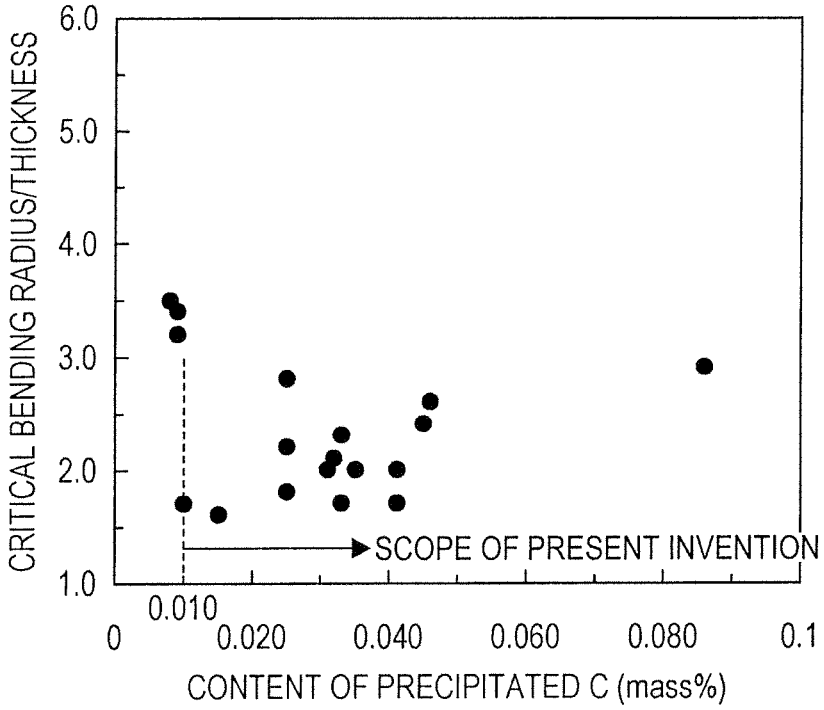
FIG. 1 is a graph illustrating the relationship between the amount of precipitated C having a grain diameter of less than 20 nm and the ratio of a critical bending radius to thickness.

Hereafter, our steel sheets and methods will be described in detail. "%" denotes "mass %," unless otherwise noted.

First, the components of the chemical composition of our high-strength steel sheet will be described.

C: 0.04% to 0.20%

C contributes to improving the strength of a steel sheet, punching capability, and bendability by combining with Ti, Nb, and V to form fine carbides. In addition, C contributes to improving punching capability by combining with Fe to form cementite. It is necessary that the C content be 0.04% or more to achieve such effects. It is preferable that the C content be 0.06% or more, or more preferably 0.08% or more, when higher strength is required. On the other hand, when the C content is high, ferrite transformation is inhibited, and formation of fine carbides of Ti, Nb, and V is also inhibited due to formation of carbides having a large grain diameter. In addition, when the C content is excessively high, there is a deterioration in weldability, and there is a significant deterioration in toughness and formability due to formation of a large amount of cementite. Therefore, it is necessary that the C content be 0.20% or less, preferably 0.15% or less, or more preferably 0.12% or less.

Si: 0.6% to 1.5%

Si promotes ferrite transformation in a slow cooling process after hot rolling has been performed and promotes formation of fine carbides of Ti, Nb, and V that are precipitated when the transformation occurs. In addition, Si functions as a solute-strengthening chemical element to contribute to improving the strength of a steel sheet without significantly deteriorating formability. It is necessary that the Si content be 0.6% or more to achieve such effects. On the other hand, when the Si content is high, since a surface pattern called "red scale" occurs, there is an increase in the roughness of the surface of a steel sheet. In addition, since ferrite transformation is accelerated in a rapid cooling process after hot rolling has been performed and before a slow cooling process, there is an increase in the grain diameter of the precipitated carbides of Ti, Nb, and V, and there is a deterioration in toughness. In addition, since Si oxides tend to be formed on the surface, a chemical conversion defect tends to occur in a hot-rolled steel sheet and, for example, a coating defect tends to occur in a coated steel sheet. Therefore, it is necessary that the Si content be 1.5% or less. As described above, the Si content is 0.6% or more and 1.5% or less, or preferably 0.8% or more and 1.2% or less.

Mn: 1.0% to 3.0%

Mn is effective in decreasing the grain diameter of the microstructure of a steel sheet by delaying the start of ferrite transformation in a cooling process after hot rolling has been performed. Moreover, Mn can contribute to improving the strength of a steel sheet through solute strengthening. In addition, Mn has a function of rendering harmful S in steel harmless by forming MnS. It is necessary that the Mn content be 1.0% or more, preferably 1.3% or more, or more preferably 1.5% or more to achieve such effects. On the other hand, when the Mn content is high, slab cracking occurs, and the formation of fine carbides formed by the combination of C and Ti, Nb, and V is inhibited due to the progress of ferrite transformation being inhibited. Therefore, it is necessary that the Mn content be 3.0% or less, preferably 2.3% or less, or more preferably 1.6% or less.

P: 0.10% or Less

P has a function of deteriorating weldability and deteriorates the ductility, bendability, and toughness of a steel sheet as a result of being segregated at grain boundaries. Moreover, when the P content is high, since ferrite transformation is accelerated in a rapid cooling process after hot rolling has been performed and before a slow cooling process, there is an increase in the size of the precipitated carbides of Ti, Nb, and V. Therefore, it is necessary that the P content be 0.10% or less, preferably 0.05% or less, more preferably 0.03% or less, or even more preferably 0.01% or less. However, since decreasing the P content more than necessary causes an increase in manufacturing costs, it is preferable that the lower limit of the P content be 0.001%.

S: 0.030% or Less

S has a function of deteriorating weldability and significantly deteriorates surface quality by causing hot cracking as a result of significantly deteriorating ductility when hot rolling is performed. In addition, S hardly contributes to improving the strength of a steel sheet. Moreover, S exists as an impurity chemical element that deteriorates ductility, bendability, and stretch flange formability of a steel sheet by forming sulfides having a large grain diameter. Since such problems become marked when the S content is more than 0.030%, it is preferable that the S content is as small as possible. Therefore, it is necessary that the S content be 0.030% or less, preferably 0.010% or less, more preferably 0.003% or less, or even more preferably 0.001% or less. However, since decreasing the S content more than necessary causes an increase in manufacturing costs, it is preferable that the lower limit of the S content be 0.0001%.

Al: 0.10% or Less

When the Al content is high, there is a significant deterioration in the toughness and weldability of a steel sheet. Moreover, since Al oxides tend to be formed on the surface, a chemical conversion defect tends to occur in a hot-rolled steel sheet and, for example, a coating defect tends to occur in a coated steel sheet. Therefore, it is necessary that the Al content be 0.10% or less, or preferably 0.06% or less. There is no particular limitation on the lower limit of the Al content. There is no problem even when the Al content is 0.01% or more in Al killed steel.

N: 0.010% or Less

N combines with Ti, Nb, and V to form nitrides having a large grain diameter at a high temperature. However, such nitrides having a large grain diameter contribute less to improving the strength of a steel sheet, which results in a decrease in the effect of improving the strength of a steel sheet through the addition of Ti, Nb, and V, and results in deterioration in toughness. Moreover, when the N content is high, since slab cracking occurs during hot rolling, there is a risk in that surface defects occur. Therefore, it is necessary that the N content be 0.010% or less, preferably 0.005% or less, more preferably 0.003% or less, or even more preferably 0.002% or less. However, since decreasing the N content more than necessary causes an increase in manufacturing costs, it is preferable that the lower limit of the N content be 0.0001%.

One, Two, or All of Ti, Nb, and V: 0.01% to 1.0% Each

Ti, Nb, and V contribute to improving the strength of a steel sheet and bendability by combining with C to form fine carbides. It is necessary that one, two, or all of Ti, Nb, and V be added in an amount of 0.01% or more each to achieve such effects. On the other hand, when the content of each of Ti, Nb, or V is more than 1.0%, the effect of improving strength becomes saturated, and there is a deterioration in toughness due to a large amount of fine precipitates being formed. Therefore, it is necessary that the amount of each of Ti, Nb, and V be 1.0% or less.

The remainder is Fe and inevitable impurities. Examples of inevitable impurities include Sn, Mg, Co, As, Pb, Zn, and O, and it is acceptable that the content of inevitable impurities be 0.5% or less in total.

Although our steel sheets can achieve target properties with the indispensable constituent chemical elements described above, the chemical elements described below may be added as needed in addition to the indispensable constituent chemical elements described above.

One, Two, or All of Mo, Ta, and W: 0.005% to 0.50% Each

Mo, Ta, and W contribute to improving the strength and bendability of a steel sheet by forming fine precipitates. When Mo, Ta, and W are added to achieve such effects, one, two, or all of Mo, Ta, and W should be added in an amount of 0.005% or more each. On the other hand, when the content of Mo, Ta, or W is high, such effects become saturated, and there may be a deterioration in the toughness and punching capability of a steel sheet due to a large amount of fine precipitates being formed. Therefore, it is preferable that one, two, or all of Mo, Ta, and W be added in an amount of 0.50% or less each. It is preferable that one, two, or all of Mo, Ta, and W be added in an amount of 0.50% or less in total.

One, Two, or All of Cr, Ni, and Cu: 0.01% to 1.0% Each

Cr, Ni, and Cu contribute to improving the strength and bendability of a steel sheet by decreasing the grain diameter of the microstructure of a steel sheet and functioning as solute-strengthening chemical elements. When Cr, Ni, and Cu are added to achieve such effects, one, two, or all of Cr, Ni, and Cu should be added in an amount of 0.01% or more each. On the other hand, when the content of Cr, Ni, or Cu is high, such effects become saturated, and there is an increase in manufacturing costs. Therefore, it is preferable that one, two, or all of Cr, Ni, and Cu be added in an amount of 1.0% or less each.

One or Both of Ca and REM: 0.0005% to 0.01% Each

Ca and REM can improve the ductility, toughness, bendability, and stretch flange formability of a steel sheet by controlling the shape of sulfides. When Ca and REM are added to achieve such effects, one or both of Ca and REM should be added in an amount of 0.0005% or more each. On the other hand, when the content of Ca or REM is high, such effects become saturated, and there is an increase in costs. Therefore, when Ca and REM are added, it is preferable that one or both of Ca and REM be added in an amount of 0.01% or less each.

Sb: 0.005% to 0.050%

Sb, which is segregated on the surface when hot rolling is performed, can inhibit formation of nitrides having a large grain diameter by preventing N from entering a slab. When Sb is added to achieve such an effect, the Sb content is 0.005% or more. On the other hand, when the Sb content is high, there is an increase in manufacturing costs. Therefore, in the case where Sb is added, the Sb content is 0.050% or less.

B: 0.0005% to 0.0030%

B can contribute to improving the strength and bendability of a steel sheet by decreasing the grain diameter of the microstructure of a steel sheet. When B is added to achieve such an effect, the B content is 0.0005% or more, or preferably 0.0010% or more. On the other hand, when the B content is high, there is an increase in rolling load when hot rolling is performed. Therefore, when B is added, the B content is 0.0030% or less, or preferably 0.0020% or less.

Hereafter, the microstructure and the like that relate to important requirements for the steel sheet will be described.

Ferrite: 50% or More in Terms of Area Ratio

Since ferrite is excellent in terms of ductility and bendability, the area ratio of ferrite is 50% or more, preferably 70% or more, more preferably 80% or more, or even more preferably 90% or more to obtain a steel sheet having excellent ductility and bendability. Phases other than ferrite may be, for example, pearlite, bainite, martensite, and retained austenite. It is possible to determine the area ratio of ferrite by using the method described below. In addition, it is possible to control the area ratio of ferrite to be 50% or more by controlling the manufacturing conditions, in particular, cooling rate when slow cooling is performed.

Average Grain Diameter at a Position Located 50 μm From the Surface of a Steel Sheet in the Thickness Direction: 3000×[tensile strength TS (MPa)]$^{-0.85}$ μm or Less It is possible to inhibit the propagation of cracks when bend forming is performed by decreasing grain diameter in the vicinity of the surface of a steel sheet. Moreover, since there is an increased tendency for cracks to propagate with an improvement in strength of a steel sheet, it is necessary that the grain diameter be controlled to be smaller. Regarding such a grain diameter in the vicinity of the surface of a steel sheet, it is possible to evaluate the grain diameter more appropriately at a position located 50 μm from the surface of a steel sheet in the thickness direction, which is exposed by removing scale, than on the outermost surface of the steel sheet. Therefore, the average grain diameter at a position located 50 μm from the surface of a steel sheet in the thickness direction is specified. The term "a position located 50 μm from the surface of a steel sheet in the thickness direction" denotes a position located 50 μm from the surface of a steel sheet in the thickness direction, which is exposed by removing scale and is also referred to as "a position located 50 μm from the surface layer."

It is possible to achieve excellent bendability as a result of inhibiting propagation of cracks when bend forming is performed by controlling the average grain diameter at a position located 50 μm from the surface layer to be 3000×[tensile strength TS (MPa)]$^{-0.85}$ μm or less, preferably 2500×[tensile strength TS (MPa)]$^{-0.85}$ μm or less, more preferably 2000×[tensile strength TS (MPa)]$^{-0.85}$ μm or less, or even more preferably 1500×[tensile strength TS (MPa)]$^{-0.85}$ μm or less. Although there is no particular limitation on the lower limit of the average grain diameter, it is satisfactory that the lower limit be about 0.5 μm. It is possible to determine the average grain diameter at a position located 50 μm from the surface layer by using the method described below. In addition, it is possible to control the average grain diameter at a position located 50 μm from the surface layer by controlling the manufacturing conditions, in particular, the accumulated rolling reduction ratio, finishing delivery temperature, and so forth when hot rolling is performed.

C Content in Precipitates Having a Grain Diameter of Less Than 20 nm Formed in Steel: 0.010% or More Among precipitates formed in steel, precipitates having a grain diameter of less than 20 nm can contribute to improving the strength and bendability of a steel sheet. Such fine precipitates are classified mainly into carbides. Therefore, to achieve such an effect, it is necessary that the C content in precipitates having a grain diameter of less than 20 nm (hereinafter, also referred to as "amount of precipitated C" for short) be 0.010% or more, or preferably 0.015% or more. On the other hand, since the effect of improving strength becomes saturated when precipitates having a grain diameter of less than 20 nm are formed in steel in an amount more than necessary, it is preferable that the amount of precipitated C be 0.15% or less, more preferably 0.10% or less, or even more preferably 0.08% or less. It is possible to determine the amount of precipitated C by using the method described below. In addition, it is possible to control the amount of precipitated C to be 0.010% or more by controlling the manufacturing conditions. Amount of precipitated Fe: 0.03% to 1.0%

Cementite is effective in smoothing the punched end surface of a material for a member when the material is subjected to punching. To achieve such an effect, it is necessary that a certain amount or more of cementite be formed. The amount of precipitated Fe is specified by using the amount of Fe precipitated in the form of cementite (hereinafter, also referred to as "amount of precipitated Fe") as the index of the amount of cementite. The amount of precipitated Fe is 0.03% or more, preferably 0.05% or more, or more preferably 0.10% or more to achieve the effect of smoothing the punched end surface of a material for a member. On the other hand, when the amount of precipitated Fe is large, since cementite becomes a starting point at which embrittlement fracturing occurs, there is a deterioration in bendability. Therefore, the amount of precipitated Fe is 1.0% or less, preferably 0.50% or less, or more preferably 0.30% or less. It is possible to determine the amount of precipitated Fe by using the method described below. In addition, it is possible to control the amount of precipitated Fe to be 0.03% to 1.0% by controlling the manufacturing conditions, in particular, coiling temperature.

Arithmetic Average Roughness Ra: 3.0 μm or Less

By decreasing the arithmetic average roughness of the surface of a high-strength steel sheet, it is possible to inhibit formation of a starting point at which cracking occurs when a punched material is subjected to bend forming. Therefore, it is necessary that the arithmetic average roughness (Ra) be 3.0 μm or less, preferably 2.0 μm or less, more preferably 1.5 μm or less, or even more preferably 1.0 μm or less. Although there is no particular limitation on the lower limit of the arithmetic average roughness, it is preferable that the lower limit be about 0.5 μm. It is possible to determine the arithmetic average roughness Ra by using the method described below.

Hereafter, our methods of manufacturing the high-strength steel sheet will be described.

Our high-strength steel sheets are manufactured by casting a steel slab having the chemical composition described above, reheating the steel slab to a temperature of 1200° C. or higher, optionally without reheating, performing hot rolling on the steel slab in which descaling is performed with an impingement pressure of 3 MPa or more after rough rolling has been performed and before finish rolling is performed with an accumulated rolling reduction ratio of 0.7 or more in a temperature range of 950° C. or lower and a finishing delivery temperature of 800° C. or higher, performing rapid water cooling with a maximum impingement pressure of 5 kPa or more at an average cooling rate of 30° C./s or more after finish rolling has been performed and before slow cooling is started, performing slow cooling from a slow-cooling start temperature of 550° C. to 750° C. at an average cooling rate of less than 10° C./s for a slow-cooling time of 1 second to 10 seconds, further performing cooling to a coiling temperature of 350° C. or higher and lower than 530° C. at an average cooling rate of 10° C./s or more, and performing coiling at a coiling temperature of 350° C. or higher and lower than 530° C. Pickling may be performed after coiling has been performed. Moreover, after pickling has been performed, annealing at a soaking temperature of 750° C. or lower followed by a hot-dip coating treatment or an electroplating treatment may be performed. After the hot-dip coating treatment has been performed, an alloying treatment at an alloying treatment temperature of 460° C. to 600° C. for a holding time of 1 second or more may be performed. In addition, work with a thickness-decreasing ratio of 0.1% to 3.0% may be performed on the high-strength steel sheet manufactured as described above.

Details will be described hereafter.

There is no particular limitation on the method used to prepare molten steel, and a known method such as one which utilizes a converter or an electric furnace may be used. In addition, secondary refining may be performed by using a vacuum degassing furnace. Subsequently, a slab (steel) is manufactured by using a continuous casting method from the viewpoint of productivity and product quality. In addition, slabs may be manufactured by using a known casting method such as an ingot casting-slabbing method or a thin-slab continuous casting method.

Cast Slab: Performing Hot Direct Rolling on Cast Slab or Reheating Warm or Cold Cast Slab to a Temperature of 1200° C. or Higher It is necessary to dissolve Ti, Nb, and V in steel before hot rolling is started to finely precipitate these chemical elements. Therefore, it is preferable that a cast slab in a hot state be transported to the entrance of a hot rolling mill to perform hot rolling (hot direct rolling). However, when a cast slab is cooled to be a warm or cold piece in which the precipitates of Ti, Nb, and V are formed, it is necessary that the slab be reheated to a temperature of 1200° C. or higher to redissolve Ti, Nb, and V before rough rolling is started. When the slab heating temperature is low, since the redissolution of Ti, V, and Nb is inhibited, these chemical elements are retained in the form of carbides having a large grain diameter, which results in formation of fine carbides being inhibited. Although there is no particular limitation on the holding time at a temperature of 1200° C. or higher, it is preferable that the holding time be 10 minutes or more, or more preferably 30 minutes or more. It is preferable that the upper limit of the holding time be 180 minutes or less from the viewpoint of operation load. In addition, it is preferable that the reheating temperature be 1220° C. or higher, or more preferably 1250° C. or higher. It is preferable that the upper limit of the reheating temperature be 1300° C. or lower from the viewpoint of operation load. Hot rolling: performing descaling with an impingement pressure of 3 MPa or more after rough rolling has been performed and before finish rolling is performed with an accumulated rolling reduction ratio of 0.7 or more in a temperature range of 950° C. or lower and a finishing delivery temperature of 800° C. or higher Descaling is performed by using high-pressure water at the entrance of a finish rolling mill after rough rolling has been performed and before finish rolling is performed. At this time, the impingement pressure of the high-pressure water is 3 MPa or more. When the impingement pressure is low, since it is not possible to completely remove scale, a part of scale remains unremoved on the surface. When the steel sheet in such a state is subjected to finish rolling, since the retained scale is pressed onto the surface of the steel sheet, there is an increase in the surface roughness of the steel sheet. Therefore, it is necessary that the impingement pressure of high-pressure water at the entrance of a finish rolling mill be 3 MPa or more, preferably 5 MPa or more, more preferably 8 MPa or more, or even more preferably 10 MPa or more. Although there is no particular limitation on the upper limit of the impingement pressure, it is preferable that the upper limit be 15 MPa. Although there is no particular limitation on the descaling time, it is preferable that the descaling time be 0.1 seconds to 5 seconds to prevent the temperature of a steel sheet from excessively decreasing during finish rolling. The term "impingement pressure" above denotes force per unit area on the surface of a steel material when high-pressure water impinges on the surface of the steel material.

The Accumulated Rolling Reduction Ratio in a Temperature Range of 950° C. or Lower in Finish Rolling: 0.7 or More When the rolling reduction ratio in a low temperature range is large in finish rolling, it is possible to decrease ferrite grain diameter. Therefore, the accumulated rolling reduction ratio in a temperature range of 950° C. or lower is 0.7 or more, preferably 1.0 or more, more preferably 1.3 or more, or even more preferably 1.6 or more. Although there is no particular limitation on the upper limit of the accumulated rolling reduction ratio, it is preferable that the upper limit be 2.0. The term "the accumulated rolling reduction ratio" denotes the sum of the rolling reduction ratios of the rolling stands used for finish rolling in a temperature range of 950° C. or lower, where the rolling reduction ratio of each of the rolling stands is defined by the ratio of thickness at the entrance of the stand to that at the exit of the stand.

Finishing Delivery Temperature: 800° C. or Higher

When the finishing delivery temperature is low, since ferrite transformation occurs in a high temperature range in a rapid cooling process after hot rolling has been performed and before slow cooling is performed, there is an increase in the grain diameter of precipitated carbides of Ti, Nb, and V. Moreover, when the finishing delivery temperature is in a temperature range in which ferrite is formed, there is an increase in ferrite grain diameter, and there is an increase in the grain diameter of precipitated carbides of Ti, Nb, and V due to strain-induced precipitation. Therefore, the finishing delivery temperature is 800° C. or higher, preferably 820° C. or higher, or more preferably 850° C. or higher. Although there is no particular limitation on the upper limit of the finishing delivery temperature, it is preferable that the upper limit be 920° C.

Cooling With a Maximum Impingement Pressure of Cooling Water of 5 kPa or More at an Average Cooling Rate of 30° C./s or More After Finish Rolling Has Been Performed and Before Slow Cooling is Started (Rapid Cooling Before Slow Cooling is Performed)

Maximum Impingement Pressure of Cooling Water After Finish Rolling Has Been Performed and Before Slow Cooling is Started: 5 kPa or More Rapid cooling with water is performed on a steel sheet after finish rolling has been performed and before slow cooling is started. At this time, when the maximum impingement pressure of cooling water is high, it is possible to decrease ferrite grain diameter in the surface layer of a steel sheet. Therefore, the maximum impingement pressure of cooling water after finish rolling has been performed and before slow cooling is started is 5 kPa or more, preferably 10 kPa or more, or more preferably 15 kPa or more. Although there is no particular limitation on the upper limit of the maximum impingement pressure, it is preferable that the upper limit be 200 kPa. The term "maximum impingement pressure" above denotes the maximum force per unit area on the surface of a steel material when high-pressure water impinges on the surface of the steel material.

Average Cooling Rate After Finish Rolling Has Been Performed and Before Slow Cooling is Started: 30° C./s or More When the average cooling rate is low when rapid cooling is performed after finish rolling has been performed and before slow cooling is started, there is an increase in ferrite grain diameter due to ferrite transformation occurring in a high temperature range, and there is an increase in the grain diameter of precipitated carbides of Ti, Nb, and V. Therefore, the average cooling rate after finish rolling has been performed and before slow cooling is started is 30° C./s or more, preferably 50° C./s or more, or more preferably 80° C./s or more. Although there is no particular limitation on the upper limit of the average cooling rate, it is preferable that the upper limit be 200° C./s from the viewpoint of temperature control.

Slow Cooling From a Slow-Cooling Start Temperature of 550° C. to 750° C. at an Average Cooling Rate of Less Than 10° C./s for a Slow-Cooling Time of 1 Second to 10 Seconds Slow-Cooling Start Temperature: 550° C. to 750° C.

When the slow-cooling start temperature is high, there is an increase in ferrite crystal grain diameter due to ferrite transformation occurring in a high temperature range, and there is an increase in the grain diameter of precipitated carbides of Ti, Nb, and V. Therefore, it is necessary that the slow-cooling start temperature be 750° C. or lower. On the other hand, when the slow-cooling start temperature is low, sufficient precipitation of carbides of Ti, Nb, and V does not occur. Therefore, it is necessary that the slow-cooling start temperature be 550° C. or higher.

Average Cooling Rate When Slow Cooling is Performed: Less Than 10° C./s

When the cooling rate when slow cooling is performed is high, since sufficient ferrite transformation does not occur, there is a decrease in the area ratio of ferrite. In addition, there is a decrease in the amount of precipitated fine carbides of Ti, Nb, and V. Therefore, the average cooling rate when slow cooling is performed is set to be less than 10° C./s, or preferably less than 6° C./s. Although there is no particular limitation on the lower limit of the average cooling rate, it is preferable that the lower limit be 4° C./s, which is almost equal to the cooling rate of air cooling.

Slow-Cooling Time: 1 Second to 10 Seconds

When the slow-cooling time is short, sufficient ferrite transformation does not occur. In addition, there is a decrease in the amount of precipitated fine carbides of Ti, Nb, and V. Therefore, the slow-cooling time is 1 second or more, preferably 2 seconds or more, or more preferably 3 seconds or more. On the other hand, the slow-cooling time is long, there is an increase in the grain diameter of carbides of Ti, Nb, and V, and there is an increase in crystal grain diameter. Therefore, it is necessary that the slow-cooling time be 10 seconds or less, or preferably 6 seconds or less. The slow-cooling stop temperature is appropriately determined in accordance with the slow-cooling start temperature, the cooling rate, and the slow-cooling time. Cooling to a coiling temperature of 350° C. or higher and lower than 530° C. at an average cooling rate of 10° C./s or more When the cooling rate from the slow-cooling stop temperature to the coiling temperature is low, there is an increase in the grain diameter of carbides of Ti, Nb, and V. In addition, there is an increase in ferrite crystal grain diameter. Therefore, the average cooling rate from the slow-cooling stop temperature to the coiling temperature is 10° C./s or more, preferably 30° C./s or more, or more preferably 50° C./s or more. Although there is no particular limitation on the upper limit of the average cooling rate, it is preferable that the upper limit be 100° C./s from the viewpoint of temperature control.

Coiling Temperature: 350° C. or Higher and Lower Than 530° C.

When the coiling temperature is high, there is an increase in the grain diameter of carbides of Ti, Nb, and V. In addition, there is an increase in ferrite grain diameter. Therefore, it is necessary that the coiling temperature be lower than 530° C., or preferably lower than 480° C. On the other hand, when the coiling temperature is low, formation of cementite, which is a precipitate composed of Fe and C, is inhibited. Therefore, the coiling temperature is 350° C. or higher.

As described above, the high-strength steel sheet is manufactured. In the description above, the finishing delivery temperature and the coiling temperature are represented by the surface temperature of a steel sheet. The average cooling rate to a slow-cooling start temperature after finish rolling has been performed, the average cooling rate when slow cooling is performed, and the average cooling rate from the slow-cooling stop temperature to the coiling temperature are specified on the basis of the surface temperature of a steel sheet.

Pickling After Coiling Has Been Performed (Preferable Condition)

Pickling may be performed on the high-strength steel sheet obtained as described above. There is no particular limitation on the method used for pickling. Examples of a method of pickling include one which utilizes hydrochloric acid or sulfuric acid. By performing pickling, since scale is removed from the surface of a steel sheet, there is an improvement in phosphatability and paint adhesiveness. In addition, there is an improvement in coating adhesiveness when a hot-dip coating treatment or an electroplating treatment is subsequently performed.

In addition, since the material properties of the high-strength steel sheet are not influenced by a coating treatment or the chemical composition of a molten bath, a coating treatment such as a galvanizing treatment, a galvannealing treatment, or an electroplating treatment may be performed.

Hot-Dip Coating Treatment Following Annealing at a Soaking Temperature of 750° C. or Lower After Pickling Has Been Performed (Preferable Condition)

After pickling has been performed, annealing is performed at a soaking temperature of 750° C. or lower. By controlling the soaking temperature to be 750° C. or lower, it is possible to inhibit an increase in the grain diameter of carbides of Ti, Nb, and V and an increase in crystal grain diameter. Subsequently, a hot-dip coating treatment is performed by dipping a steel sheet in a molten bath. For example, in a galvanizing treatment, it is preferable that the temperature of a molten bath is 420° C. to 500° C. When the temperature of the molten bath is lower than 420° C., zinc is not melted. On the other hand, when the temperature of the molten bath is higher than 500° C., alloying excessively progresses.

Alloying Treatment at an Alloying Treatment Temperature of 460° C. to 600° C. for a Holding Time of 1 Second or More After Hot-Dip Coating Treatment Has Been Performed (Preferable Condition)

After hot-dip coating treatment has been performed, it is possible to obtain a galvannealed steel sheet by reheating a steel sheet to a temperature of 460° C. to 600° C. and holding the reheated steel sheet at the reheating temperature for a holding time of 1 second or more. When the reheating temperature is lower than 460° C., sufficient alloying does not occur. On the other hand, when the reheating temperature is higher than 600° C., alloying excessively progresses. In addition, when the holding time is less than 1 second, sufficient alloying does not occur. The reheating temperature is represented by the surface temperature of a steel sheet.

Electroplating Treatment After Pickling Has Been Performed

By performing an electroplating treatment after pickling has been performed, it is possible to form a zinc coating layer, a zinc-Al-compound coating layer, a zinc-Ni-compound coating layer, an Al coating layer, or an Al—Si-compound coating layer on the surface of a steel sheet.

Work With a Thickness-Decreasing Ratio of 0.1% to 3.0%

By performing light work on the high-strength steel sheet obtained as described above, it is possible to improve punching capability by increasing the number of movable dislocations. It is preferable that the light work be performed with a thickness-decreasing ratio of 0.1% or more, or more preferably 0.3% or more to achieve such an effect. On the other hand, when the thickness-decreasing ratio is large, since dislocations are less movable due to the interaction among the dislocations, there is a deterioration in punching capability. Therefore, when light work is performed, it is preferable that the thickness-decreasing ratio is 3.0% or less, more preferably 2.0% or less, or even more preferably 1.0% or less. Examples of such light work include performing rolling reduction on the steel sheet through the use of rolling rolls and performing tensile work on a steel sheet by applying tension to the steel sheet. Moreover, a combination of rolling and tensile work may be performed.

Example 1

Molten steels having the chemical compositions given in Table 1 were prepared by using a commonly known method and cast by using a continuous casting method to obtain steel slabs. These slabs were subjected to hot rolling, cooling, and coiling under the manufacturing conditions given in Table 2 to obtain hot-rolled steel sheets. In addition, some of the steel sheets were subjected to pickling (hydrochloric acid concentration: 10 mass %, temperature: 80° C.) and a coating treatment under the conditions given in Table 2.

The following tests and evaluations were performed on test pieces taken from the high-strength steel sheets obtained as described above. In coated steel sheets, steel sheets subjected to a coating treatment were subjected to the tests and the evaluations.

Ferrite Area Ratio

A cross section in the rolling-thickness direction was embedded, polished, subjected to etching with nital, and observed by using a scanning electron microscope (SEM) in regions of 100 μm×100 μm centered at a position located at ¼ of the thickness at a magnification of 1000 times to obtain three photographs, and the obtained photographs were subjected to image analysis to obtain the ferrite area ratio.

Average Grain Diameter at Position Located 50 μm From Surface Layer

A cross section in the rolling-thickness direction was embedded, polished, subjected to etching with nital, and subjected to EBSD observation at intervals of 0.1 μm to determine the average grain diameter, where a misorientation of 15° or more was regarded as indicating a grain boundary. In an observation length 500 μm at a position located 50 μm from the surface layer from which scale had been removed, the circle-equivalent diameter of each of all the crystal grains existing at a position located at 50 μm from the surface layer was determined, and the average value of the determined diameters was defined as the average grain diameter.

Amount of Precipitated C

As described in Japanese Patent No. 4737278, by performing constant-current electrolysis in a 10% AA-based electrolytic solution (10 vol. % acetylacetone-1 mass % tetramethylammonium chloride-methanol electrolytic solution) with a test piece taken from the steel sheet being set at the anode to dissolve a certain amount of test piece, and by filtering the obtained electrolytic solution through the use of a filter having a filter pore size of 20 nm to obtain the filtrate, the contents of Ti, Nb, V, Mo, Ta, and W in the obtained filtrate were determined by performing ICP emission spectrometry. The determined results were converted into the amount of precipitated C, under the assumption that all of Ti, Nb, V, Mo, Ta, and W were contained in the form of carbides.

Amount of Precipitated Fe

By performing constant-current electrolysis in a 10% AA-based electrolytic solution with a test piece taken from the steel sheet being set at the anode to dissolve a certain amount of test piece, by filtering the obtained electrolytic solution through the use of a filter having a filter pore size of 0.2 μm to collect Fe precipitates in the extraction residue, dissolving the collected Fe precipitates in mixed acid, and performing ICP emission spectrometry on the obtained acid solution to determine the amount of Fe, the amount of Fe in the Fe precipitates was calculated from the determined value. Since Fe precipitates are aggregated, it is also possible to collect Fe precipitates having a grain diameter of less than 0.2 μm by performing filtering through the use of a filter having a filter pore size of 0.2 μm.

Arithmetic Average Roughness Ra

Ra was determined in accordance with JIS B 0601. By determining the arithmetic average roughness in a direction at a right angle to the rolling direction 5 times, the average value of the determined values was defined as Ra. The Ra of a steel sheet after a coating treatment had been performed was determined in the case of a coated steel sheet, and the Ra of a steel sheet after pickling had been performed was determined in a hot-rolled steel sheet.

Mechanical Properties

By performing a tensile test in accordance with JIS Z 2241 on a JIS No. 5 tensile test piece taken from the steel sheet so that the longitudinal direction of the test piece was a direction at a right angle to the rolling direction, yield strength (YP), tensile strength (TS), and total elongation (El) were determined. The test was performed on two test pieces, and the average value of the two for each of the mechanical properties was defined as the value for each of the mechanical properties of the steel sheet.

Bending Test

By taking a plate of 35 mm×100 mm from the steel sheet by performing punching with a clearance of 15% so that the longitudinal direction of the plate was a direction at a right angle to the rolling direction, a V-bending test at an angle of 90° was performed with the burr being on the inner side of bending. The pressing load was 5 tons to 10 tons, and the pressing speed was 50 mm/min. Then, the minimum tip radius of a punch for V-bending with which no cracking occurred at a peak of V-bending position in the vicinity of a punched surface was determined. Cracking was judged by performing a visual observation on the surface of the plate at the peak of bending position. When no cracking occurred when the test was performed 3 times was judged as a case of no cracking, and the minimum radius with which no cracking occurred (minimum radius without cracking) was defined as critical bending radius. Then, when the value of (critical bending radius/thickness) was 3.0 or less was judged as a case of excellent bending workability.

The results obtained as described above are given in Table 3.

TABLE 1

| Sample | Chemical Composition (mass %) | | | | | | | | | | |
|---|---|---|---|---|---|---|---|---|---|---|---|
| No. | C | Si | Mn | P | S | Al | N | Ti | Nb | V | Other |
| 1 | 0.11 | 1.1 | 1.5 | 0.01 | 0.002 | 0.05 | 0.003 | 0.14 | — | 0.26 | Cu = 0.4, Ni = 0.2, Ca = 0.003 |
| 2 | 0.21 | 1.1 | 1.4 | 0.08 | 0.015 | 0.04 | 0.005 | 0.11 | 0.05 | 0.35 | Mo = 0.50 |
| 3 | 0.04 | 1.2 | 1.5 | 0.02 | 0.002 | 0.03 | 0.005 | 0.10 | — | 0.05 | Cr = 0.3 |
| 4 | 0.11 | 0.9 | 1.6 | 0.01 | 0.001 | 0.06 | 0.005 | 0.13 | — | 0.27 | Mo = 0.1 |
| 5 | 0.08 | 0.9 | 1.2 | 0.01 | 0.015 | 0.04 | 0.004 | 0.17 | — | 0.20 | |
| 6 | 0.18 | 1.0 | 1.4 | 0.02 | 0.002 | 0.05 | 0.004 | — | — | 0.73 | |
| 7 | 0.08 | 1.2 | 1.5 | 0.02 | 0.002 | 0.06 | 0.004 | 0.10 | 0.05 | 0.11 | Mo = 0.05, Ta = 0.05, W = 0.03, Cr = 0.05, Ni = 0.05, Cu = 0.1, Ca = 0.002, REM = 0.001, Sb = 0.010, B = 0.0015 |
| 8 | 0.08 | 1.2 | 1.3 | 0.03 | 0.002 | 0.02 | 0.005 | 0.11 | — | 0.25 | |
| 9 | 0.08 | 0.8 | 1.5 | 0.01 | 0.001 | 0.04 | 0.005 | 0.11 | 0.12 | 0.18 | |
| 10 | 0.05 | 1.0 | 1.5 | 0.01 | 0.001 | 0.05 | 0.004 | 0.20 | — | — | |
| 11 | 0.09 | 1.1 | 3.1 | 0.03 | 0.001 | 0.04 | 0.004 | 0.10 | — | 0.25 | |
| 12 | 0.08 | 1.5 | 2.1 | 0.08 | 0.025 | 0.08 | 0.005 | 0.15 | — | 0.25 | |
| 13 | 0.06 | 1.1 | 1.4 | 0.02 | 0.003 | 0.04 | 0.004 | 0.17 | — | — | |
| 14 | 0.12 | 1.2 | 2.8 | 0.01 | 0.015 | 0.08 | 0.009 | 0.21 | 0.15 | 0.23 | W = 0.10 |
| 15 | 0.11 | 1.0 | 1.6 | 0.01 | 0.002 | 0.05 | 0.005 | 0.13 | — | 0.38 | Ta = 0.1 |
| 16 | 0.06 | 1.6 | 1.6 | 0.02 | 0.002 | 0.02 | 0.006 | 0.15 | — | 0.11 | Cr = 0.10 |
| 17 | 0.10 | 1.0 | 1.5 | 0.01 | 0.001 | 0.05 | 0.004 | 0.14 | — | 0.28 | Ca = 0.003 |
| 18 | 0.06 | 1.1 | 1.6 | 0.01 | 0.001 | 0.01 | 0.005 | 0.18 | — | — | |
| 19 | 0.07 | 1.1 | 1.3 | 0.02 | 0.001 | 0.06 | 0.005 | 0.14 | — | 0.21 | Cu = 0.1, Ni = 0.1 |
| 20 | 0.10 | 1.1 | 1.5 | 0.02 | 0.002 | 0.04 | 0.002 | 0.11 | 0.05 | 0.25 | |
| 21 | 0.10 | 1.1 | 1.4 | 0.01 | 0.001 | 0.04 | 0.003 | 0.14 | — | 0.26 | Mo = 0.20, Ca = 0.003 |
| 22 | 0.08 | 1.0 | 1.2 | 0.01 | 0.002 | 0.05 | 0.005 | 0.12 | — | 0.15 | Ca = 0.002 |
| 23 | 0.05 | 1.0 | 1.4 | 0.05 | 0.001 | 0.05 | 0.003 | 0.15 | — | — | |
| 24 | 0.15 | 0.7 | 1.2 | 0.01 | 0.002 | 0.06 | 0.005 | 0.06 | — | 0.45 | |
| 25 | 0.03 | 1.0 | 1.5 | 0.04 | 0.001 | 0.05 | 0.004 | 0.15 | — | — | |
| 26 | 0.12 | 1.1 | 1.2 | 0.02 | 0.001 | 0.05 | 0.006 | 0.12 | — | 0.22 | Mo = 0.23 |
| 27 | 0.15 | 1.2 | 1.5 | 0.01 | 0.002 | 0.06 | 0.007 | 0.08 | — | 0.55 | |
| 28 | 0.12 | 1.1 | 1.3 | 0.02 | 0.001 | 0.03 | 0.006 | 0.12 | — | 0.32 | B = 0.0010 |

TABLE 1-continued

| Sample No. | Chemical Composition (mass %) | | | | | | | | | | |
|---|---|---|---|---|---|---|---|---|---|---|---|
| | C | Si | Mn | P | S | Al | N | Ti | Nb | V | Other |
| 29 | 0.08 | 1.4 | 1.4 | 0.02 | 0.001 | 0.04 | 0.004 | 0.15 | — | 0.27 | Cu = 0.2, Ni = 0.1, Ca = 0.003 |
| 30 | 0.09 | 1.1 | 1.4 | 0.01 | 0.001 | 0.04 | 0.003 | 0.11 | — | 0.21 | Sb = 0.015 |
| 31 | 0.05 | 0.8 | 1.5 | 0.02 | 0.008 | 0.03 | 0.003 | 0.15 | — | — | |
| 32 | 0.15 | 1.2 | 1.3 | 0.01 | 0.022 | 0.06 | 0.005 | 0.05 | — | 0.35 | Mo = 0.30, Ta = 0.11, W = 0.12 |
| 33 | 0.08 | 1.2 | 0.9 | 0.02 | 0.001 | 0.05 | 0.005 | 0.08 | — | 0.25 | |
| 34 | 0.07 | 0.5 | 1.5 | 0.01 | 0.005 | 0.05 | 0.003 | 0.13 | — | 0.11 | |

TABLE 2

| Sample No. | Hot Rolling | | | | | | | |
|---|---|---|---|---|---|---|---|---|
| | Slab Reheating Temperature (° C.) | Holding Time (minute) | Impingement Pressure of High-pressure Water (MPa) | Accumulated Rolling Reduction Ratio at 950° C. or Lower | Finishing Delivery Temperature (° C.) | Maximum Impingement Pressure before Slow Cooling Is Started (kPa) | Average Cooling Rate before Slow Cooling Is Started (° C./s) | Slow-cooling Start Temperature (° C.) |
| 1 | 1230 | 10 | 8 | 1.3 | 920 | 15 | 60 | 630 |
| 2 | 1250 | 30 | 5 | 0.8 | 850 | 8 | 70 | 730 |
| 3 | 1260 | 30 | 5 | 1.2 | 860 | 14 | 90 | 670 |
| 4 | 1230 | 10 | 8 | 0.7 | 850 | 20 | 70 | 680 |
| 5 | 1260 | 30 | 8 | 0.9 | 790 | 8 | 90 | 680 |
| 6 | 1260 | 30 | 6 | 1.2 | 880 | 10 | 100 | 660 |
| 7 | 1250 | 30 | 6 | 1.0 | 880 | 15 | 85 | 650 |
| 8 | 1250 | 20 | 5 | 1.1 | 850 | 7 | 80 | 540 |
| 9 | 1270 | 20 | 5 | 1.2 | 870 | 10 | 30 | 660 |
| 10 | 1250 | 30 | 5 | 1.0 | 880 | 10 | 80 | 650 |
| 11 | 1230 | 40 | 3 | 1.5 | 840 | 8 | 110 | 620 |
| 12 | 1260 | 30 | 7 | 1.6 | 860 | 200 | 150 | 680 |
| 13 | 1240 | 50 | 9 | 1.5 | 810 | 10 | 80 | 620 |
| 14 | (*3) | — | 10 | 1.2 | 840 | 65 | 85 | 690 |
| 15 | 1250 | 50 | 5 | 1.8 | 840 | 15 | 30 | 580 |
| 16 | 1260 | 20 | 5 | 1.5 | 860 | 5 | 80 | 650 |
| 17 | 1260 | 40 | 6 | 1.2 | 890 | 15 | 100 | 640 |
| 18 | 1250 | 30 | 7 | 1.0 | 870 | 6 | 25 | 680 |
| 19 | 1260 | 30 | 4 | 1.3 | 860 | 12 | 80 | 650 |
| 20 | 1220 | 40 | 2 | 1.3 | 880 | 15 | 110 | 640 |
| 21 | 1260 | 30 | 10 | 1.4 | 800 | 8 | 110 | 750 |
| 22 | 1250 | 30 | 11 | 1.4 | 890 | 12 | 40 | 630 |
| 23 | 1180 | 30 | 8 | 1.4 | 850 | 12 | 120 | 610 |
| 24 | 1250 | 20 | 8 | 1.4 | 840 | 100 | 120 | 670 |
| 25 | 1220 | 40 | 6 | 1.1 | 880 | 5 | 80 | 720 |
| 26 | 1260 | 30 | 6 | 1.2 | 850 | 5 | 70 | 760 |
| 27 | 1230 | 10 | 8 | 1.3 | 840 | 8 | 50 | 690 |
| 28 | 1200 | 60 | 15 | 1.1 | 820 | 5 | 50 | 560 |
| 29 | 1240 | 30 | 3 | 2.0 | 900 | 30 | 90 | 710 |
| 30 | 1230 | 20 | 8 | 0.9 | 870 | 8 | 70 | 640 |
| 31 | 1240 | 50 | 12 | 1.1 | 860 | 4 | 80 | 670 |
| 32 | 1250 | 30 | 10 | 0.6 | 870 | 10 | 80 | 650 |
| 33 | 1270 | 30 | 4 | 1.4 | 910 | 6 | 90 | 630 |
| 34 | 1250 | 30 | 10 | 1.3 | 830 | 10 | 60 | 680 |

| Sample No. | Hot Rolling | | | | Coating | | | | Thickness-Decreasing Ratio (%) |
|---|---|---|---|---|---|---|---|---|---|
| | Average Cooling Rate when Slow Cooling Is Performed (° C./s) | Slow-cooling Time (s) | Average Cooling Rate from Slow-cooling Stop Temperature to Coiling Temperature (° C./s) | Coiling Temperature (° C.) | Kind of Coating | Soaking Temperature (° C.) | Reheating Temperature (° C.) | Holding Time (s) | |
| 1 | 3 | 8 | 30 | 350 | — | — | — | — | 1.1 |
| 2 | 5 | 4 | 25 | 420 | — | — | — | — | — |
| 3 | 5 | 5 | 25 | 400 | — | — | — | — | — |
| 4 | 4 | 3 | 15 | 500 | — | — | — | — | 0.6 |
| 5 | 5 | 5 | 35 | 450 | — | — | — | — | 0.8 |
| 6 | 5 | 6 | 25 | 400 | Zn (*1) | 740 | 550 | 3 | — |

TABLE 2-continued

| | | | | | | | | | |
|---|---|---|---|---|---|---|---|---|---|
| 7 | 5 | 2 | 25 | 450 | — | — | — | — | — |
| 8 | 8 | 5 | 30 | 470 | — | — | — | — | — |
| 9 | 5 | 3 | 25 | 550 | — | — | — | — | — |
| 10 | 5 | 3 | 20 | 450 | — | — | — | — | — |
| 11 | 6 | 1 | 35 | 480 | — | — | — | — | — |
| 12 | 7 | 4 | 50 | 460 | — | — | — | — | 2.8 |
| 13 | 8 | 11 | 25 | 450 | — | — | — | — | — |
| 14 | 6 | 3 | 40 | 420 | — | — | — | — | — |
| 15 | 9 | 2 | 15 | 450 | — | — | — | — | — |
| 16 | 6 | 2 | 30 | 450 | — | — | — | — | — |
| 17 | 4 | 4 | 25 | 460 | — | — | — | — | — |
| 18 | 5 | 5 | 25 | 460 | — | — | — | — | — |
| 19 | 7 | 4 | 35 | 330 | — | — | — | — | — |
| 20 | 4 | 5 | 45 | 470 | — | — | — | — | — |
| 21 | 6 | 1 | 30 | 520 | Zn (*1) | 700 | — | — | — |
| 22 | 4 | 3 | 8 | 440 | — | — | — | — | 0.1 |
| 23 | 6 | 4 | 40 | 450 | — | — | — | — | — |
| 24 | 6 | 5 | 35 | 410 | — | — | — | — | — |
| 25 | 5 | 4 | 25 | 400 | — | — | — | — | — |
| 26 | 6 | 4 | 35 | 480 | — | — | — | — | — |
| 27 | 12 | 5 | 30 | 470 | — | — | — | — | — |
| 28 | 8 | 5 | 10 | 420 | — | — | — | — | 0.1 |
| 29 | 4 | 10 | 35 | 380 | Zn + Ni (*2) | — | — | — | — |
| 30 | 4 | 4 | 30 | 430 | — | — | — | — | — |
| 31 | 4 | 4 | 25 | 420 | — | — | — | — | — |
| 32 | 5 | 4 | 40 | 450 | — | — | — | — | — |
| 33 | 5 | 4 | 35 | 460 | Zn (*1) | 710 | — | — | — |
| 34 | 4 | 3 | 35 | 430 | — | — | — | — | — |

(*1) Hot-dip galvanizing layer
(*2) Ni-zinc electroplating layer
(*3) Sample No. 14 was subjected to hot direct rolling.

TABLE 3

| | Microstructure | | | | | Mechanical Property | | | | | |
|---|---|---|---|---|---|---|---|---|---|---|---|
| Sample No. | Amount of Precipitated C (mass %) | Amount of Precipitated Fe (mass %) | Ferrite Fraction (%) | Average Grain Diameter at Position Located 50 μm from Surface Layer (μm) | Arithmetic Average Roughness (μm) | Thickness (mm) | YP (MPa) | TS (MPa) | El (%) | Critical Bending Radius/ Thickness | Note |
| 1 | 0.031 | 0.21 | 84 | 5.2 | 1.1 | 2.6 | 870 | 990 | 19 | 2.0 | Example |
| 2 | 0.061 | 1.1 | 75 | 5.1 | 1.3 | 3.2 | 1070 | 1190 | 15 | 5.5 | Comparative Example |
| 3 | 0.010 | 0.03 | 94 | 7.5 | 1.6 | 2.6 | 680 | 780 | 23 | 1.7 | Example |
| 4 | 0.041 | 0.09 | 88 | 5.5 | 1.1 | 3.6 | 910 | 1010 | 18 | 2.0 | Example |
| 5 | 0.021 | 0.18 | 81 | 9.0 | 1.0 | 2.3 | 800 | 940 | 20 | 4.2 | Comparative Example |
| 6 | 0.086 | 0.92 | 76 | 2.9 | 1.3 | 2.9 | 1050 | 1200 | 15 | 2.9 | Example |
| 7 | 0.025 | 0.11 | 85 | 6.5 | 1.6 | 2.6 | 760 | 900 | 20 | 1.8 | Example |
| 8 | 0.009 | 0.03 | 85 | 6.1 | 1.3 | 3.2 | 810 | 950 | 20 | 4.1 | Comparative Example |
| 9 | 0.018 | 0.16 | 83 | 8.9 | 1.3 | 2.3 | 810 | 960 | 18 | 4.6 | Comparative Example |
| 10 | 0.015 | 0.04 | 95 | 7.2 | 1.2 | 2.9 | 750 | 830 | 21 | 1.6 | Example |
| 11 | 0.015 | 0.13 | 45 | 5.2 | 2.5 | 3.2 | 820 | 960 | 19 | 4.2 | Comparative Example |
| 12 | 0.035 | 0.03 | 62 | 1.9 | 2.1 | 2.9 | 880 | 1020 | 18 | 2.0 | Example |
| 13 | 0.012 | 0.11 | 89 | 10.3 | 1.0 | 2.6 | 690 | 810 | 22 | 3.8 | Comparative Example |
| 14 | 0.041 | 0.31 | 50 | 3.2 | 1.0 | 2.6 | 1000 | 1120 | 17 | 1.7 | Example |
| 15 | 0.045 | 0.11 | 87 | 4.0 | 1.2 | 2.0 | 940 | 1100 | 16 | 2.4 | Example |
| 16 | 0.009 | 0.03 | 99 | 6.5 | 3.5 | 2.6 | 750 | 860 | 21 | 3.8 | Comparative Example |
| 17 | 0.032 | 0.06 | 85 | 5.3 | 1.5 | 2.9 | 860 | 990 | 19 | 2.1 | Example |
| 18 | 0.012 | 0.06 | 88 | 10.3 | 1.2 | 2.6 | 670 | 810 | 21 | 3.7 | Comparative Example |
| 19 | 0.021 | 0.02 | 79 | 7.5 | 1.4 | 2.1 | 770 | 900 | 21 | 4.1 | Comparative Example |
| 20 | 0.031 | 0.21 | 84 | 4.1 | 3.2 | 2.6 | 860 | 1010 | 17 | 4.2 | Comparative Example |
| 21 | 0.025 | 0.07 | 86 | 4.4 | 0.9 | 4.0 | 920 | 1050 | 17 | 2.2 | Example |
| 22 | 0.021 | 0.12 | 75 | 9.2 | 0.9 | 2.3 | 800 | 950 | 19 | 4.5 | Comparative Example |
| 23 | 0.009 | 0.08 | 95 | 6.9 | 1.3 | 2.6 | 670 | 790 | 21 | 3.2 | Comparative Example |
| 24 | 0.046 | 0.63 | 78 | 2.6 | 1.2 | 2.3 | 950 | 1090 | 17 | 2.6 | Example |
| 25 | 0.009 | 0.02 | 93 | 7.6 | 1.2 | 2.9 | 680 | 790 | 22 | 3.4 | Comparative Example |
| 26 | 0.021 | 0.22 | 76 | 8.6 | 1.2 | 2.6 | 880 | 1020 | 17 | 4.4 | Comparative Example |
| 27 | 0.032 | 0.55 | 45 | 3.5 | 1.2 | 2.9 | 990 | 1150 | 16 | 4.3 | Comparative Example |
| 28 | 0.033 | 0.15 | 88 | 8.2 | 0.7 | 2.6 | 860 | 1000 | 18 | 2.3 | Example |
| 29 | 0.025 | 0.15 | 85 | 2.2 | 2.8 | 2.3 | 880 | 1020 | 17 | 2.8 | Example |
| 30 | 0.033 | 0.11 | 95 | 7.5 | 1.4 | 2.1 | 750 | 890 | 20 | 1.7 | Example |
| 31 | 0.013 | 0.07 | 92 | 10.4 | 0.9 | 2.6 | 680 | 800 | 22 | 3.6 | Comparative Example |
| 32 | 0.054 | 0.46 | 75 | 7.5 | 1.1 | 2.3 | 1060 | 1210 | 15 | 5.3 | Comparative Example |

TABLE 3-continued

| | Microstructure | | | | | Mechanical Property | | | | | |
|---|---|---|---|---|---|---|---|---|---|---|---|
| Sample No. | Amount of Precipitated C (mass %) | Amount of Precipitated Fe (mass %) | Ferrite Fraction (%) | Average Grain Diameter at Position Located 50 μm from Surface Layer (μm) | Arithmetic Average Roughness (μm) | Thickness (mm) | YP (MPa) | TS (MPa) | El (%) | Critical Bending Radius/ Thickness | Note |
| 33 | 0.025 | 0.12 | 88 | 9.1 | 1.8 | 2.9 | 800 | 950 | 19 | 4.2 | Comparative Example |
| 34 | 0.008 | 0.15 | 55 | 6.9 | 0.9 | 2.6 | 700 | 810 | 22 | 3.5 | Comparative Example |

As indicated in Table 3, high-strength steel sheets having excellent bendability were obtained in our examples.

Figure 2:
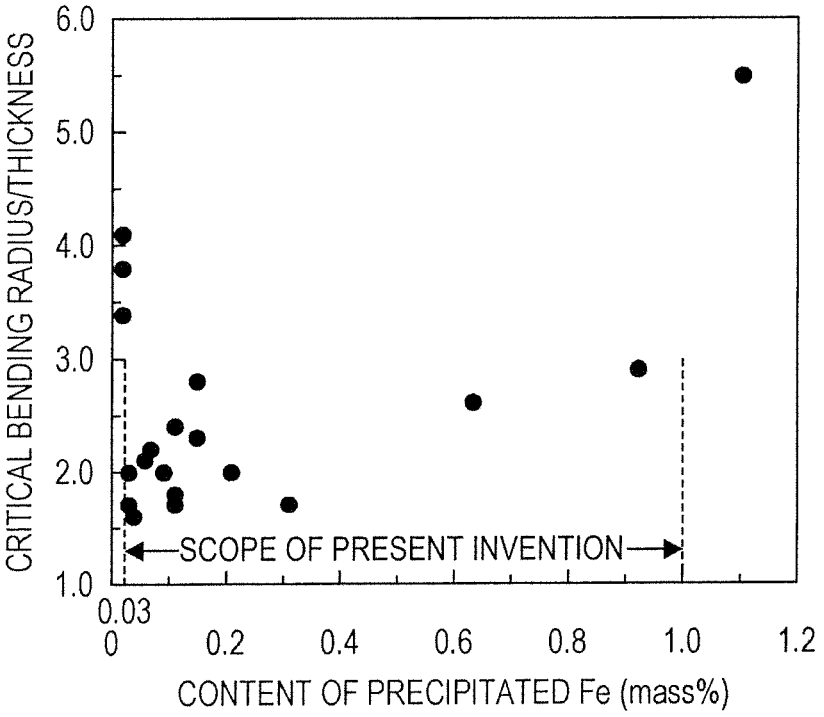
FIG. 2 is a graph illustrating the relationship between the amount of precipitated Fe and the ratio of a critical bending radius to thickness.
Figure 3:
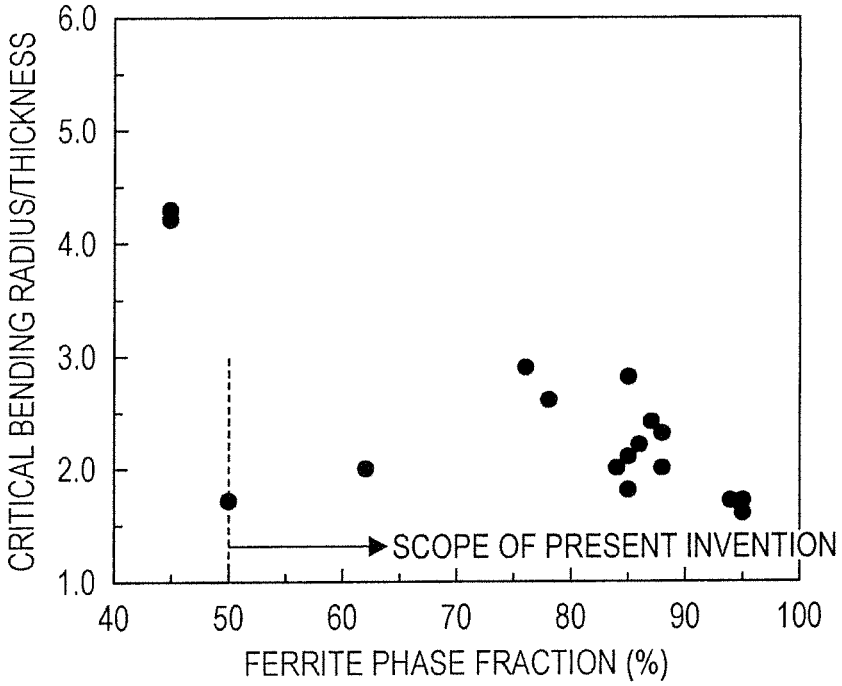
FIG. 3 is a graph illustrating the relationship between the ferrite fraction and the ratio of a critical bending radius to thickness.
Figure 4:
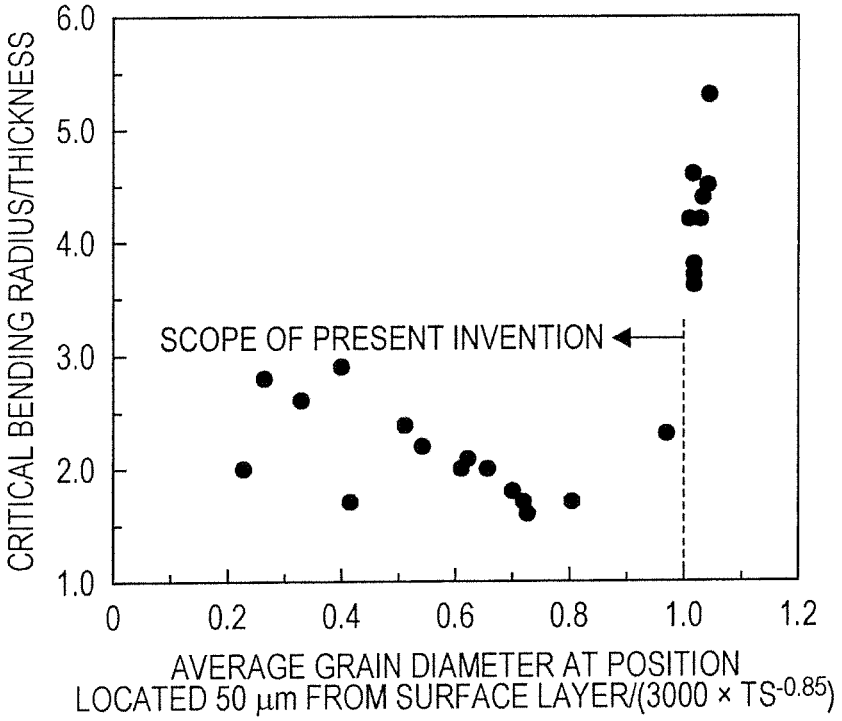
FIG. 4 is a graph illustrating the relationship between an average grain diameter at a position located 50 μm from the surface layer divided by 3000×TS$^{-0.85}$ and the ratio of a critical bending radius to thickness.
Figure 5:
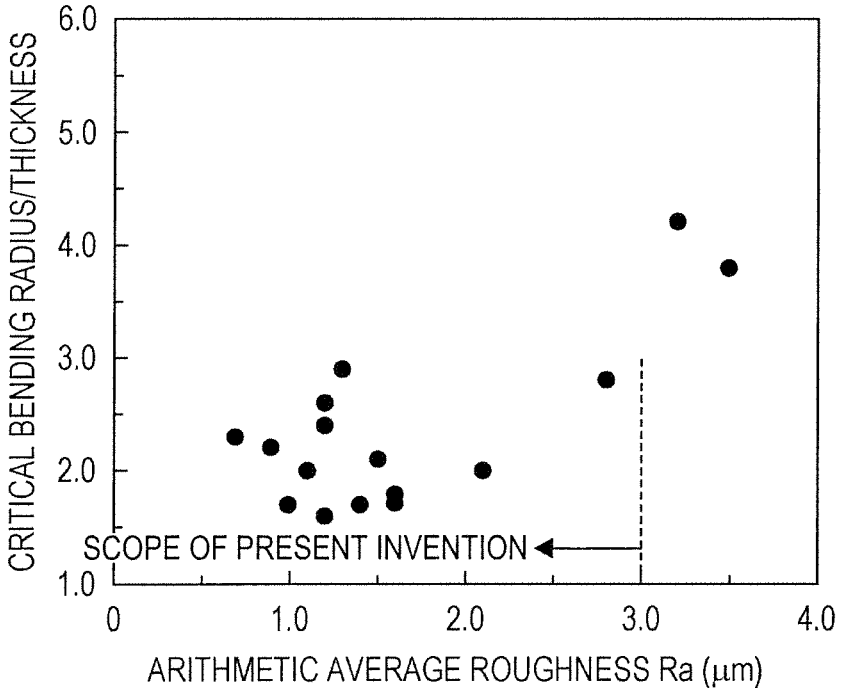
FIG. 5 is a graph illustrating the relationship between an arithmetic average roughness and the ratio of a critical bending radius to thickness.

FIGS. 1 through 5 are produced by organizing the results given in Table 3. FIG. 1 is a graph illustrating the relationship between the amount of precipitated C and the ratio of a critical bending radius to thickness. FIG. 2 is a graph illustrating the relationship between the amount of precipitated Fe and the ratio of a critical bending radius to thickness. FIG. 3 is a graph illustrating the relationship between the ferrite fraction and the ratio of a critical bending radius to thickness. FIG. 4 is a graph illustrating the relationship between an average grain diameter at a position located 50 μm from the surface layer divided by $3000\times TS^{-0.85}$ and the ratio of a critical bending radius to thickness. FIG. 5 is a graph illustrating the relationship between an arithmetic average roughness and the ratio of a critical bending radius to thickness.

As indicated in FIG. 1, it is possible to control the value of (critical bending radius/thickness) to be 3.0 or less by controlling the amount of precipitated C to be within our range.

As indicated in FIG. 2, it is possible to control the value of (critical bending radius/thickness) to be 3.0 or less by controlling the amount of precipitated Fe to be within our range.

As indicated in FIG. 3, it is possible to control the value of (critical bending radius/thickness) to be 3.0 or less by controlling the ferrite fraction to be within our range.

As indicated in FIG. 4, it is possible to control the value of (critical bending radius/thickness) to be 3.0 or less by controlling average grain diameter at a position located 50 μm from the surface layer to be within our range.

As indicated in FIG. 5, it is possible to control the value of (critical bending radius/thickness) to be 3.0 or less by controlling arithmetic average roughness to be within our range.

The invention claimed is:

1. A high-strength steel sheet having a chemical composition containing, by mass %, C: 0.04% to 0.20%, Si: 0.6% to 1.5%, Mn: 1.0% to 3.0%, P: 0.10% or less, S: 0.030% or less, Al: 0.10% or less, N: 0.010% or less, one, two, or all of Ti, Nb, and V in an amount of 0.01% to 1.0% each, and the balance being Fe and inevitable impurities, a microstructure including, in terms of area ratio, 50% or more of ferrite, wherein an average grain diameter at a position located 50 μm from a surface of the steel sheet in a thickness direction is $3000\times(\text{tensile strength TS (MPa)})^{-0.85}$ μm or less, a C content in precipitates having a grain diameter of less than 20 nm formed in steel is 0.010 mass % or more, and an amount of precipitated Fe is 0.03 mass % to 1.0 mass %, where the amount of precipitated Fe is an amount of Fe precipitated in a form of cementite, an arithmetic average roughness Ra of 3.0 μm or less, and a value of critical bending radius/thickness is 3.0 or less.

2. The high-strength steel sheet according to claim 1, wherein the chemical composition further contains, by mass %, at least one of groups (A) to (E):

(A) one, two, or all of Mo, Ta, and W in an amount of 0.005% to 0.50% each, (B) one, two, or all of Cr, Ni, and Cu in an amount of 0.01% to 1.0% each, (C) one or both of Ca and REM in an amount of 0.0005% to 0.01% each, (D) Sb: 0.005% to 0.050%, and (E) B: 0.0005% to 0.0030%.

3. The high-strength steel sheet according to claim 1, the steel sheet further comprising a coating layer on the surface thereof.

4. A method of manufacturing the high-strength steel sheet according to claim 1, the method comprising:

casting a steel slab having the chemical composition, reheating the steel slab to a temperature of 1200° C. or higher, optionally without reheating, performing hot rolling on the steel slab in which descaling is performed with an impingement pressure of 3 MPa or more after rough rolling has been performed and before finish rolling is performed with an accumulated rolling reduction ratio of 0.7 or more in a temperature range of 950° C. or lower and a finishing delivery temperature of 800° C. or higher, performing rapid water cooling with a maximum impingement pressure of 5 kPa or more at an average cooling rate of 30° C./s or more after finish rolling has been performed and before slow cooling is started, performing slow cooling from a slow-cooling start temperature of 550° C. to 750° C. at an average cooling rate of less than 10° C./s for a slow-cooling time of 1 second to 10 seconds, further performing cooling to a coiling temperature of 350° C. or higher and lower than 530° C. at an average cooling rate of 10° C./s or more, and performing coiling at a coiling temperature of 350° C. or higher and lower than 530° C.

5. The method according to claim 4, the method further comprising performing pickling after the coiling has been performed.

6. The method according to claim 5, the method further comprising performing a hot-dip coating treatment following annealing at a soaking temperature of 750° C. or lower after the pickling has been performed.

7. The method according to claim 6, the method further comprising performing an alloying treatment at an alloying treatment temperature of 460° C. to 600° C. for a holding time of 1 second or more after the hot-dip coating treatment has been performed.

8. The method according to claim 5, the method further comprising performing an electroplating treatment after the pickling has been performed.

9. The method according to claim 4, the method further comprising processing with a thickness-decreasing ratio of 0.1% to 3.0% after the coiling, the pickling, the hot-dip coating treatment, the alloying treatment, or the electroplating treatment has been performed.

10. A method of manufacturing a high-strength steel sheet, the method comprising performing a coating treatment on the high-strength steel sheet according to claim 1.

11. The high-strength steel sheet according to claim 2, the steel sheet further having a coating layer on the surface thereof.

12. A method of manufacturing the high-strength steel sheet according to claim 2, the method comprising:

casting a steel slab having the chemical composition, reheating the steel slab to a temperature of 1200° C. or higher, optionally without reheating, performing hot rolling on the steel slab in which descaling is performed with an impingement pressure of 3 MPa or more after rough rolling has been performed and before finish rolling is performed with an accumulated rolling reduction ratio of 0.7 or more in a temperature range of 950° C. or lower and a finishing delivery temperature of 800° C. or higher, performing rapid water cooling with a maximum impingement pressure of 5 kPa or more at an average cooling rate of 30° C./s or more after finish rolling has been performed and before slow cooling is started, performing slow cooling from a slow-cooling start temperature of 550° C. to 750° C. at an average cooling rate of less than 10° C./s for a slow-cooling time of 1 second to 10 seconds, further performing cooling to a coiling temperature of 350° C. or higher and lower than 530° C. at an average cooling rate of 10° C./s or more, and performing coiling at a coiling temperature of 350° C. or higher and lower than 530° C.

13. The method according to claim 12, further comprising performing pickling after the coiling has been performed.

14. The method according to claim 13, further comprising performing a hot-dip coating treatment following annealing at a soaking temperature of 750° C. or lower after the pickling has been performed.

15. The method according to claim 14, further comprising performing an alloying treatment at an alloying treatment temperature of 460° C. to 600° C. for a holding time of 1 second or more after the hot-dip coating treatment has been performed.

16. The method according to claim 13, further comprising performing an electroplating treatment after the pickling has been performed.

* * * * *